US007285714B2

(12) United States Patent
Juszkiewicz et al.

(10) Patent No.: US 7,285,714 B2
(45) Date of Patent: Oct. 23, 2007

(54) PICKUP FOR DIGITAL GUITAR

(75) Inventors: Henry E. Juszkiewicz, Nashville, TN (US); Jeffrey P. Kaleta, Clarksville, TN (US)

(73) Assignee: Gibson Guitar Corp., Nashville, TN (US)

( * ) Notice: Subject to any disclaimer, the term of this patent is extended or adjusted under 35 U.S.C. 154(b) by 116 days.

(21) Appl. No.: 11/223,778

(22) Filed: Sep. 9, 2005

(65) Prior Publication Data

US 2007/0056435 A1 Mar. 15, 2007

(51) Int. Cl.
*G10H 3/18* (2006.01)
*G10H 3/14* (2006.01)

(52) U.S. Cl. ..... 84/726; 84/727; 84/728; 84/298

(58) Field of Classification Search ..... 84/726, 84/728, 298, 727
See application file for complete search history.

(56) References Cited

U.S. PATENT DOCUMENTS

| | | | | | |
|---|---|---|---|---|---|
| 2,573,254 | A | * | 10/1951 | Fender | 84/727 |
| 2,968,204 | A | | 1/1961 | Fender | 84/1.16 |
| 3,066,567 | A | | 12/1962 | Kelley, Jr. | 84/1.16 |
| 3,073,202 | A | | 1/1963 | Evans | 84/1.14 |
| 3,073,203 | A | | 1/1963 | Evans | 84/1.16 |
| 3,080,785 | A | | 3/1963 | Evans | 84/1.16 |
| 3,249,677 | A | | 5/1966 | Burns et al. | 84/1.16 |
| 3,453,920 | A | * | 7/1969 | Scherer | 84/731 |
| 3,530,228 | A | | 9/1970 | Scherer | 84/1.16 |
| 3,539,700 | A | | 11/1970 | Johnson | 84/1.16 |
| 3,571,483 | A | | 3/1971 | Davidson | 84/1.16 |
| 3,712,951 | A | | 1/1973 | Rickard | 84/1.14 |
| 3,983,777 | A | * | 10/1976 | Bartolini | 84/726 |
| 3,983,778 | A | * | 10/1976 | Bartolini | 84/726 |

(Continued)

FOREIGN PATENT DOCUMENTS

JP 2006-189666 7/2006

(Continued)

OTHER PUBLICATIONS

Exhibit A. Printout from www.helpwantedproductions.com/guitsyn.htm, dated Jun. 4, 2004 entitled "The Roland GR Series Analog Bass and Guitar Synthesizers".

(Continued)

*Primary Examiner*—Lincoln Donovan
*Assistant Examiner*—Christina Russell
(74) *Attorney, Agent, or Firm*—Waddey & Patterson, P.C.; Lucian Wayne Beavers

(57) ABSTRACT

A reluctance pickup for a guitar including a pair of magnetic pole pieces disposed within wire coils. The coils are oppositely wound and wired in series. Each pole piece has an elongated magnetic pole end extending above its respective coil. The pole pieces are disposed so as to form a pickup face having two approximately parallel elongated pole ends. The elongated pole ends have opposite magnetic polarities and create a magnetic field therebetween. The pickup is mounted beneath a magnetically permeable string such that a projection of the string intersects the pole ends at a selected orientation angle between approximately 28 degrees and approximately 58 degrees, preferably, 43 degrees, so as to optimize selected performance parameters of the pickup, including: channel-to-channel separation, frequency response, and dynamic response.

22 Claims, 7 Drawing Sheets

U.S. PATENT DOCUMENTS

| | | | | | |
|---|---|---|---|---|---|
| 4,026,178 | A | | 5/1977 | Fuller | 84/1.16 |
| 4,096,780 | A | * | 6/1978 | Dawson | 84/726 |
| 4,160,401 | A | | 7/1979 | Tomioka | 84/1.16 |
| 4,182,213 | A | | 1/1980 | Iodice | 84/1.15 |
| 4,189,969 | A | | 2/1980 | Katayama et al. | 84/1.14 |
| 4,211,139 | A | | 7/1980 | Murakami | 84/1.14 |
| 4,236,433 | A | | 12/1980 | Holland | 84/1.16 |
| 4,248,120 | A | | 2/1981 | Dickson | 84/1.16 |
| 4,336,734 | A | | 6/1982 | Polson | 84/1.01 |
| 4,348,930 | A | * | 9/1982 | Chobanian et al. | 84/726 |
| 4,378,721 | A | | 4/1983 | Kaneko et al. | 84/1.14 |
| 4,378,722 | A | * | 4/1983 | Isakson | 84/726 |
| 4,437,377 | A | | 3/1984 | Mitari et al. | 84/1.01 |
| 4,450,744 | A | * | 5/1984 | Shubb | 84/731 |
| 4,463,648 | A | * | 8/1984 | Fender | 84/728 |
| 4,491,051 | A | * | 1/1985 | Barcus | 84/731 |
| 4,499,809 | A | * | 2/1985 | Clevinger | 84/726 |
| 4,534,258 | A | * | 8/1985 | Anderson | 84/728 |
| 4,535,668 | A | * | 8/1985 | Schaller | 84/727 |
| 4,567,805 | A | | 2/1986 | Clevinger | 84/731 |
| 4,603,321 | A | | 7/1986 | Gutman et al. | 340/347 |
| 4,624,172 | A | | 11/1986 | McDougall | 84/726 |
| 4,630,520 | A | | 12/1986 | Bonanno | 84/1.16 |
| 4,686,881 | A | | 8/1987 | Fender | 84/1.15 |
| 4,702,141 | A | | 10/1987 | Bonanno | 84/1.16 |
| 4,730,530 | A | | 3/1988 | Bonanno | 84/1.16 |
| 4,748,887 | A | | 6/1988 | Marshall | 84/1.15 |
| 4,794,838 | A | | 1/1989 | Corriga, III | 84/1.01 |
| 4,805,510 | A | | 2/1989 | De Dianous | 84/1.16 |
| 4,809,578 | A | * | 3/1989 | Lace, Jr. | 84/726 |
| 4,817,484 | A | | 4/1989 | Iba et al. | 84/1.16 |
| 4,823,667 | A | | 4/1989 | Deutsch et al. | 84/1.16 |
| 4,858,509 | A | | 8/1989 | Marshall | 84/1.16 |
| 4,860,625 | A | | 8/1989 | Mathews | 84/1.16 |
| 4,867,027 | A | | 9/1989 | Barbera | 84/731 |
| 4,911,054 | A | * | 3/1990 | McClish | 84/725 |
| 4,941,388 | A | * | 7/1990 | Hoover et al. | 84/726 |
| 5,078,041 | A | | 1/1992 | Schmued | 84/731 |
| 5,079,984 | A | | 1/1992 | Kosugi et al. | 84/645 |
| 5,085,119 | A | | 2/1992 | Cole | 84/724 |
| 5,109,747 | A | | 5/1992 | Spuler | 84/731 |
| 5,140,890 | A | | 8/1992 | Elion | 84/736 |
| 5,148,733 | A | | 9/1992 | Beller | 84/726 |
| 5,153,363 | A | | 10/1992 | Fishman et al. | 84/731 |
| 5,155,285 | A | | 10/1992 | Fishman | 84/731 |
| 5,204,487 | A | | 4/1993 | Turner | 84/731 |
| 5,206,449 | A | * | 4/1993 | McClish | 84/723 |
| 5,223,660 | A | | 6/1993 | Wahlgreen | 84/731 |
| 5,233,123 | A | | 8/1993 | Rose et al. | 84/726 |
| 5,237,126 | A | * | 8/1993 | Curtis et al. | 84/724 |
| 5,260,511 | A | * | 11/1993 | Gregory | 84/740 |
| 5,270,475 | A | | 12/1993 | Weiss et al. | 84/603 |
| 5,292,999 | A | * | 3/1994 | Tumura | 84/728 |
| 5,308,916 | A | | 5/1994 | Murata et al. | 84/603 |
| 5,322,969 | A | | 6/1994 | Aaroe et al. | 84/731 |
| 5,354,949 | A | | 10/1994 | Zwaan | 84/727 |
| 5,367,117 | A | | 11/1994 | Kikuchi | 84/603 |
| 5,391,831 | A | | 2/1995 | Lace | 84/726 |
| 5,399,802 | A | | 3/1995 | Blucher | 84/726 |
| 5,410,101 | A | | 4/1995 | Sakurai | 84/731 |
| 5,455,381 | A | | 10/1995 | Juszkiewicz et al. | 84/731 |
| 5,463,185 | A | | 10/1995 | Fishman | 84/731 |
| 5,525,750 | A | | 6/1996 | Beller | 84/726 |
| 5,530,199 | A | | 6/1996 | Blucher | 84/728 |
| 5,539,147 | A | | 7/1996 | Hoshino | 84/723 |
| 5,602,353 | A | | 2/1997 | Juszkiewicz et al. | 84/298 |
| 5,610,357 | A | * | 3/1997 | Frank-Braun | 84/726 |
| 5,668,520 | A | | 9/1997 | Kinman | 336/84 R |
| 5,670,733 | A | | 9/1997 | Fishman | 84/731 |
| 5,723,805 | A | | 3/1998 | Lacombe | 84/727 |
| 5,789,689 | A | | 8/1998 | Doidic et al. | 84/603 |
| 5,831,196 | A | * | 11/1998 | Khanagov | 84/726 |
| 5,837,912 | A | | 11/1998 | Eagen | 84/267 |
| 5,877,444 | A | | 3/1999 | Hine et al. | 84/454 |
| 5,908,998 | A | * | 6/1999 | Blucher et al. | 84/728 |
| 6,191,350 | B1 | * | 2/2001 | Okulov et al. | 84/646 |
| 6,281,830 | B1 | | 8/2001 | Flety | 341/155 |
| 6,353,169 | B1 | | 3/2002 | Juszkiewicz et al. | 84/600 |
| 6,392,137 | B1 | * | 5/2002 | Isvan | 84/726 |
| 6,686,530 | B2 | | 2/2004 | Juszkiewicz et al. | 84/600 |
| 6,787,690 | B1 | | 9/2004 | Celi et al. | 84/723 |
| 7,105,731 | B1 | * | 9/2006 | Riedl | 84/200 |
| 7,166,794 | B2 | * | 1/2007 | Juszkiewicz et al. | 84/728 |
| 2003/0159570 | A1 | | 8/2003 | Toshitani | 84/645 |
| 2004/0134328 | A1 | * | 7/2004 | Yeakel | 84/298 |
| 2004/0168566 | A1 | | 9/2004 | Juszkiewicz et al. | 84/723 |
| 2006/0150806 | A1 | * | 7/2006 | Hara | 84/726 |

FOREIGN PATENT DOCUMENTS

JP 2006189666 A * 7/2006

OTHER PUBLICATIONS

Exhibit B. Printout from www.helpwantedproductions.com/guitsyn.htm, dated Jan. 2, 2003 entitled "The Roland GR Series Analog Bass and Guitar Synthesizers".

Exhibit C. Printout from www.godinguitars.com/grquickstart.htm, dated Jun. 4, 2004 entitled "Godin 13-Pin synth access (SA) guitars and the Roland GR-33", 5 pages.

Exhibit D. Article from Jul. 2003 Guitar Player Magazine, pp. 63-68 entitled "Tech Breakout! Line 6's Variax is the Ultimate Schizophonic Multitasking Guitar".

Exhibit E. Website printout dated May 23, 2003 from RiksMusic.com entitled "Line 6 Variax The world's first Digital Modeling Guitar".

Exhibit F. Printout from www.line6.com/variax/US/FAQ.asp dated Jun. 4, 2004 regarding Variax entitled "Frequently Asked Questions".

* cited by examiner

PICKUP FOR DIGITAL GUITAR

BACKGROUND OF THE INVENTION

The present invention relates generally to stringed musical instruments, reluctance pickups for stringed musical instruments and instrument equipment. More particularly, this invention pertains to guitars, guitar pickups, and guitar equipment. Even more particularly, this invention pertains to digital guitars, multi-signal guitar pickups, and digital guitar interface devices.

String instruments, such as guitars, are well known in the art and include a wide variety of different types and designs. For example, the prior art includes various types of acoustic and electric guitars. These guitars are typically adapted to receive analog audio signals, such as analog microphone signals, and to output analog audio signals, such as analog string signals (analog audio signals generated by guitar pickups when guitar strings are strummed).

The prior art includes monophonic guitars, i.e., guitars that output a single string signal when one or more of the guitar strings mounted on the guitar are strummed. The prior art also includes guitars that output a single string signal for each string mounted on a guitar. The latter type of guitar is generally referred to as a polyphonic guitar.

The traditional guitar has a plurality of guitar strings that are secured at each end and held under tension to vibrate at the appropriate frequency. The guitar strings are supported on a bridge over a transducer or pickup. In a polyphonic pickup, each sensor is dedicated to a different string of the guitar. The two common types of pickups used for this purpose are piezoelectric and magnetic pickups. On electric guitars with magnetic polyphonic pickups, the guitar strings normally do not touch the pickups. Each transducer typically includes a permanent magnet that creates a magnetic field and an electrical coil that is placed within the magnetic field. For each transducer, the corresponding strings are constructed from magnetically permeable material and the transducer is mounted upon the guitar so that at least one selected string passes through each transducer's magnetic field. When the instrument is played, the string vibrates causing the magnetically permeable material to move through the magnetic field so as to produce an oscillating magnetic flux at the windings of the corresponding coils. Thus, through magnetic induction, the vibration of the guitar strings moving within the lines of magnetic flux emanating from the pickup causes an electrical signal to be generated with the coil of the pickup.

Variable reluctance type transducers are often used to measure or detect the velocity of a moving ferromagnetic target. When the target has only one degree of freedom, such as movement in an up or down direction, the direction of velocity of the target can be determined from the polarity of the voltage induced at the sensing coil of the transducer and the magnitude of the velocity is proportional to the sensed voltage. However, if the target, such as a selected length of a vibrating guitar string, has two degrees of freedom, then the target can move in either an up or down direction or a left to right direction or any vector combination thereof. Such movement of the string at any one point along its length is described as a variable vector in the X-Y plane normal to the string at that point. This variable vector is separable into an x-component vector and a y-component vector, where the x and y axis are arbitrary Cartesian axial directions. Using a single conventional reluctance transducer with a symmetric magnetic field, the direction of movement cannot be determined from the induced voltage polarity, nor does the magnitude of the induced voltage accurately represent the magnitude of the target's velocity.

When a guitar string is plucked and released, a given point on the string vibrates in multiple directions in the transverse plane. The transverse plane, or X-Y plane, is the plane perpendicular to the axis of the string. The path of string vibration may be, for example, a precessing ellipse in the X-Y plane. Conventional magnetic polyphonic guitar pickups respond primarily to string vibrations occurring along a primary axis, such as the vertical axis—towards and away from the pickup. They also respond, but with less sensitivity, to string vibrations occurring along a secondary axis normal to the primary axis, such as the horizontal or axis—in the plane defined by the strings. As a result of this cross-axis insensitivity, string vibrations in different directions induce differently scaled voltages in the sensing coil that are inseparably mixed in the output signal. This drawback of conventional, single transducer magnetic pickups limits the measurable performance parameters of the pickups, including: frequency response, and dynamic response (i.e. signal-to-noise ratio response). As a demonstrative example, string vibrations with large amplitude in a near-horizontal direction may be indistinguishable from those with small amplitude in a near-vertical direction. The pickup may respond with different sensitivities to string vibrations of equal amplitudes in different directions.

The insufficiency of conventional guitar pickups in representatively sensing transverse string vibration in two degrees of freedom has been recognized by other inventors in the prior art. An example of a multiple pole pickup for a single string is shown in U.S. Pat. No. 4,348,930 issued to Chobanian et al. on Sep. 14, 1982 entitled Transducer For Sensing String Vibrational Movement in Two Mutually Perpendicular Planes. This patent teaches separate dedicated pole pieces and coils that are sensitive to vibration in two separate and mutually perpendicular planes. It is claimed that when the string vibrates in the sensitive plane of one of the sensors, significantly greater changes result in the magnetic flux in one pole piece than in the other pole piece.

With U.S. Pat. No. 4,534,258, entitled Transducer Assembly Responsive to String Movement in Intersecting Planes, Norman J. Anderson describes a magnetic pickup designed to determine all the transverse movement of the string. In this design, too, each coil is maximally sensitive to vibration of the string in a first plane and minimally sensitive to vibration of the string in a second plane that intersects the first plane. Anderson explains that these principal planes are preferably perpendicular and at −45 degree and +45 degree angles with respect to the top surface of the guitar body. The signals induced by the vibrations of all strings in one set of coils are combined into one audio channel, and signals induced by the vibration of all strings in the other set of coils are combined into the second audio channel.

U.S. Pat. No. 5,206,449 entitled Omniplanar Pickup for Musical Instruments, Richard E. D. McClish describes a similar arrangement of magnetic sensors, to achieve omniplanar sensitivity to string vibration. According to that invention the signals from two coils are combined after a phase shift is applied to one of the signals with respect to the other. The flux fields are coupled by proximity and they intersect at the string, go that both sensor coils respond to string vibration in any direction, and they respond with different levels of sensitivity.

U.S. Pat. No. 6,392,137 to Isvan, and assigned to the assignee of the present invention, describes a three coil pickup which is sensitive to both the vibrations in the string plane and the vibrations perpendicular to the string plane.

The Isvan pickup includes two pickup coils, each with a pole piece of like polarity and biased horizontally in opposite directions from each other, and a third pole piece having an opposite polarity. The Isvan electronic system subtracts the signals from the first and second coils to create a signal representing the vibrations in the string plane and combines the signals from the first pickup and the second pickup for determining the string vibrations perpendicular to the string plane. In one embodiment of the invention, the transducer uses one pole of the pickup as a bridge saddle for supporting the guitar string. The saddle pole of the pickup is constructed from a magnetically permeable material. The saddle pole causes the lines of magnetic flux to be carried in large part by the guitar string and allows for a reduction in the total magnetic energy requirement for the pickup's permanent magnet to reduce the cross talk between adjacent string sensors within a polyphonic pickup.

Each of the prior art patents cited above attempt to solve the X-Y sensing problem, with varying degrees of success, by resolving the variable vector of string vibration onto orthogonal axes sensed differently by the two or more coils of a pickup. Depending on the prior art system, the x-motion and y-motion components are either directly measured as separate coil signals each proportionate to either an x-motion vector or a y-motion vector or, the x-motion and y-motion components are electronically separated by phase shifting or other signal processing of the coil signals. Both prior art approaches have drawbacks. One approach requires more complicated coil configurations, the other approach requires more complicated electrical processing.

What is needed, then, is a transducer for a vibratory string that is particularly directed towards a simple, cost-effective means of optimizing X-Y motion sensing, and thus the transducer's measurable performance parameters, including: frequency response, dynamic response (i.e. signal-to-noise ratio response).

These prior art magnetic polyphonic pickups may also suffer from significant magnetic cross talk between the strings because of coil arrangement and sensitivity. Cross talk can occur when a transducer senses the vibration of adjacent strings in addition to the one immediately overlying the transducer in question. This may be caused by the second string's vibrations affecting the magnetic field at the coils of the first transducer, and may also be caused by stray magnetic flux of the second transducer affecting the readings of the first transducer's coils.

What is needed, then, is a transducer for a vibratory string that is particularly directed to providing a simple, cost-effective means of reducing cross talk between strings while optimizing X-Y motion sensing, and thus the transducer's measurable performance parameters, including: frequency response, dynamic response (i.e. signal-to-noise ratio response).

BRIEF SUMMARY OF THE INVENTION

In one preferred embodiment of the present invention a novel reluctance transducer is mounted beneath a selected string of a guitar. A pair of parallel elongated pole pieces, each of opposite magnetic polarity, and a corresponding pair of oppositely wound coils form the transducer. The twin pole piece transducer, when mounted on the guitar, is centered beneath the selected string and is rotated such that the parallel elongated pole pieces are offset from the axis of the resting string by an angle selected so as to optimize at least one measurable performance parameter of the transducer assembly during play of the guitar string. Such performance parameters include channel-to-channel separation, frequency response, and dynamic response.

In a more preferred embodiment, the first and second pole pieces are blade-type pole pieces having rectangular ends aligned such that the transducer upper surface is rectangular. Two transducer bobbins provide cores receiving the pole pieces and a base cavity receiving a permanent magnet. The transducer further includes two electrical coils connected in series and wound in opposite directions around the bobbins and pole pieces. In this configuration, the first and second coils convert sensed changes in the magnetic field to corresponding first and second electrical signals.

Without being bound by theory, the elongated pole pieces produce elongated primary and secondary lobes in the magnetic field that have unique properties in this application to pickup transducers. By changing the orientation of a transducer beneath the selected magnetically permeable string, the angle at which the vibrating string intersects the magnetic field lines is altered, as are the number of field lines intersected during such vibrations.

A novel aspect of the current invention is that the orientation angle can be selected so as to optimize the X-Y motion sensing for a given transducer. Without being bound by theory, it is expected that, in a preferred embodiment, the orientation angle is selected such that the ratio of the y-motion vector to the x-motion vector is approximately equal to a multiple of between 0.5 and 2.0 of the ratio of the y-flux vector to the x-flux vector. More preferably, the orientation angle is selected such that the ratio of the y-motion vector to the x-motion vector is approximately equal to the ratio of the y-flux vector to the x-flux vector. This novel feature has the advantage of capturing the majority of the X-Y motion without the need for the sophisticated circuit processing or pole piece/coil design of the prior art.

A second novel aspect of the current invention is that the orientation angle can be selected so as to optimize the dynamic response/signal-to-noise ratio achievable for a given transducer. Without being bound by theory, it is expected that the orientation angle is so selected such that the total magnetic flux created by a vibration of a sensed length of the selected string within the primary portion of the magnetic field is maximized. This novel feature has the advantage of increasing the sensitivity to the sensed motion of the string without increasing the sensitivity to non-directional ambient magnetic noise and, thus, increases the dynamic response/signal-to-noise ratio achievable for a given transducer.

A third novel aspect of the invention is that the orientation angle can be selected such that the portion of the magnetic field intersected by the adjacent strings is minimized. This third novel aspect maximizes the channel-to-channel separation (i.e. minimize the cross-talk or noise signals from adjacent strings 106) achievable for a given transducer.

Finally, an empirical fourth novel aspect of the present invention is that the orientation angle can be selected so as to produce a "flat" frequency response (i.e. no distortion of the frequency response curve) over the frequency range of the transducer.

DETAILED DESCRIPTION OF THE INVENTION

Figure 1:
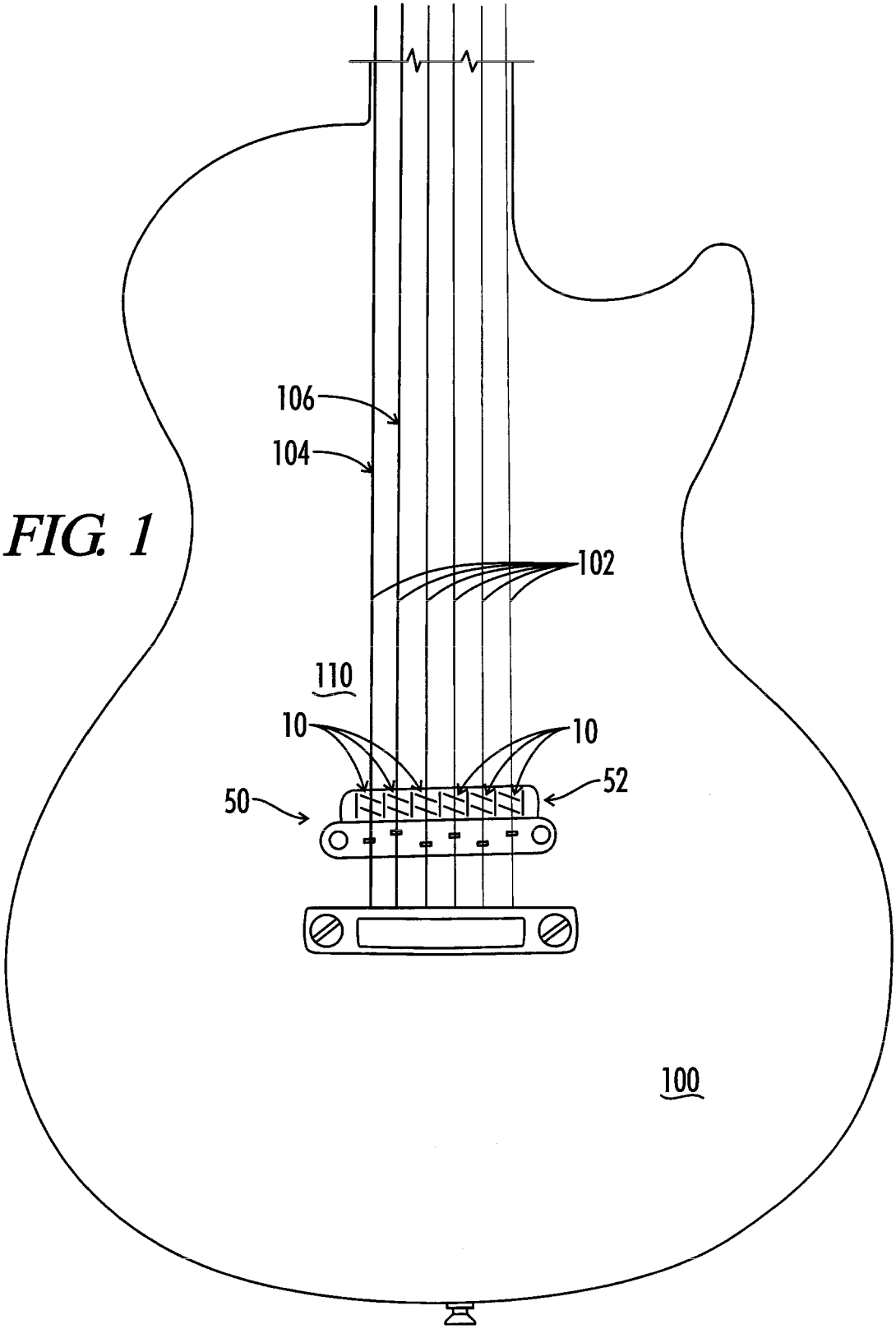
FIG. 1 is a plan view of a guitar having a plurality of the novel reluctance transducers of the invention mounted on the guitar beneath the stings.
Figure 2:
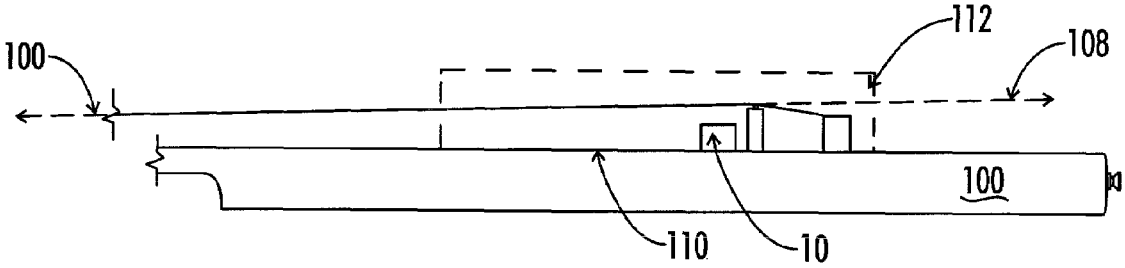
FIG. 2 is a cross-sectional view of the guitar of FIG. 1.

FIGS. 1 and 2 show an electric guitar 100 having a novel polyphonic pickup assembly 50 including six angled reluctance transducer assemblies 10 according to one embodiment of the present invention. This guitar 100 includes six magnetically permeable strings 102 extending in a generally parallel and evenly spaced span above the surface 110 of the instrument 100 so as to define a string plane 108. As is shown for one string 102 and one reference vertical plane 112 in FIG. 2, for each of the six strings 102 a separate corresponding vertical plane 112 can be defined as a plane 112 extending along the respective string 102 and generally normal to the string plane 108. The reference vertical planes 112 are, therefore, each normal to the surface 110 of the guitar 100. These reference planes are useful in describing the spatial relationships of the transducer assemblies 10 of the present invention.

Figure 3:
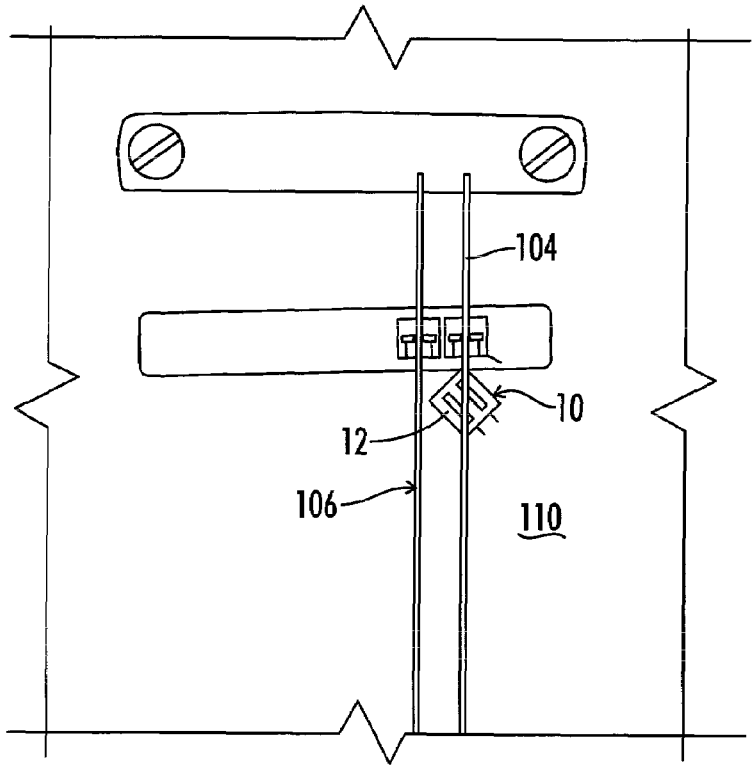
FIG. 3 is a detail view of the guitar of FIG. 1 showing a single novel reluctance transducer of the invention disposed beneath a selected string.
Figure 4:
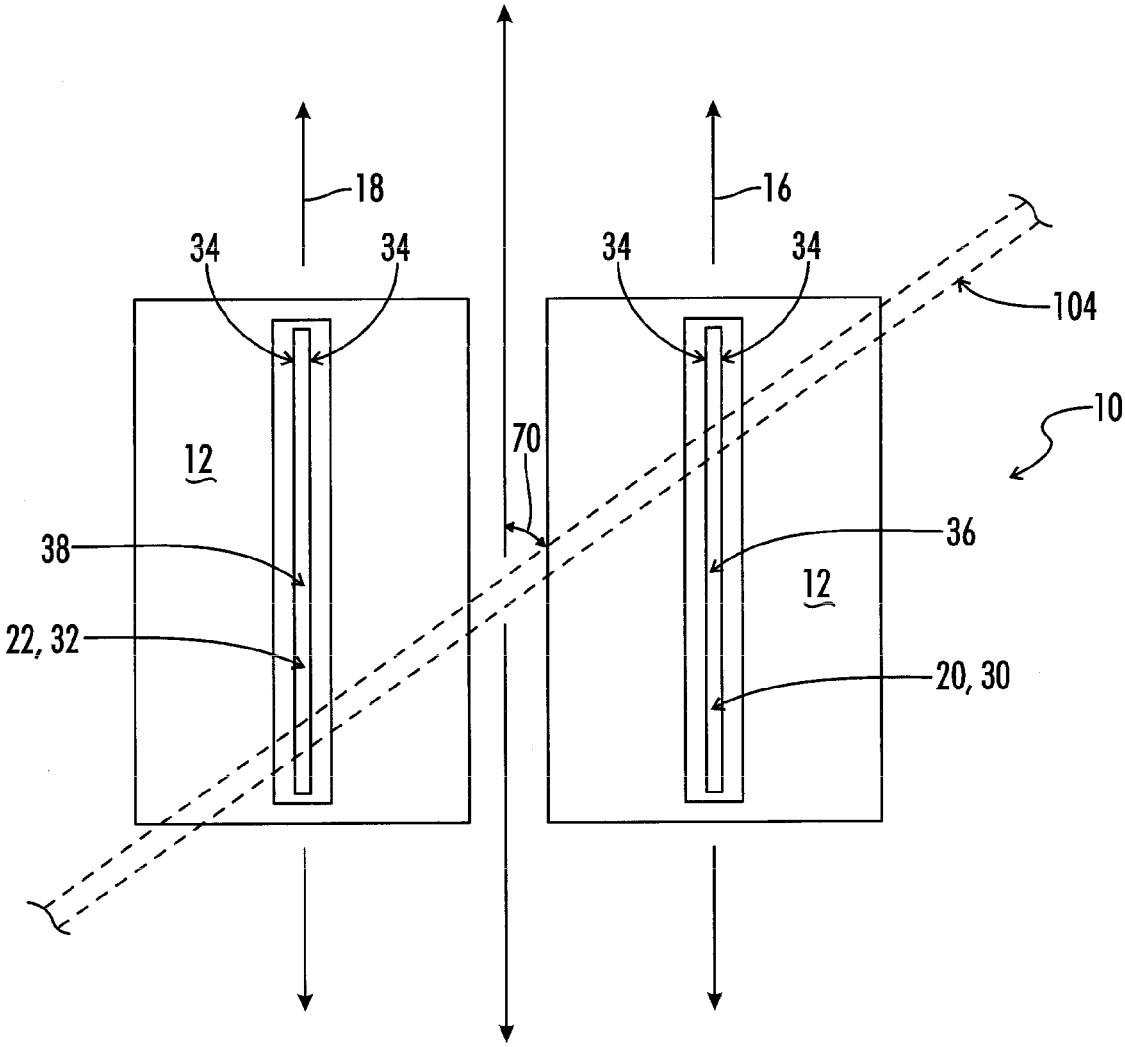
FIG. 4 is a plan view of a blade-type reluctance transducer disposed beneath a selected string.
Figure 5:
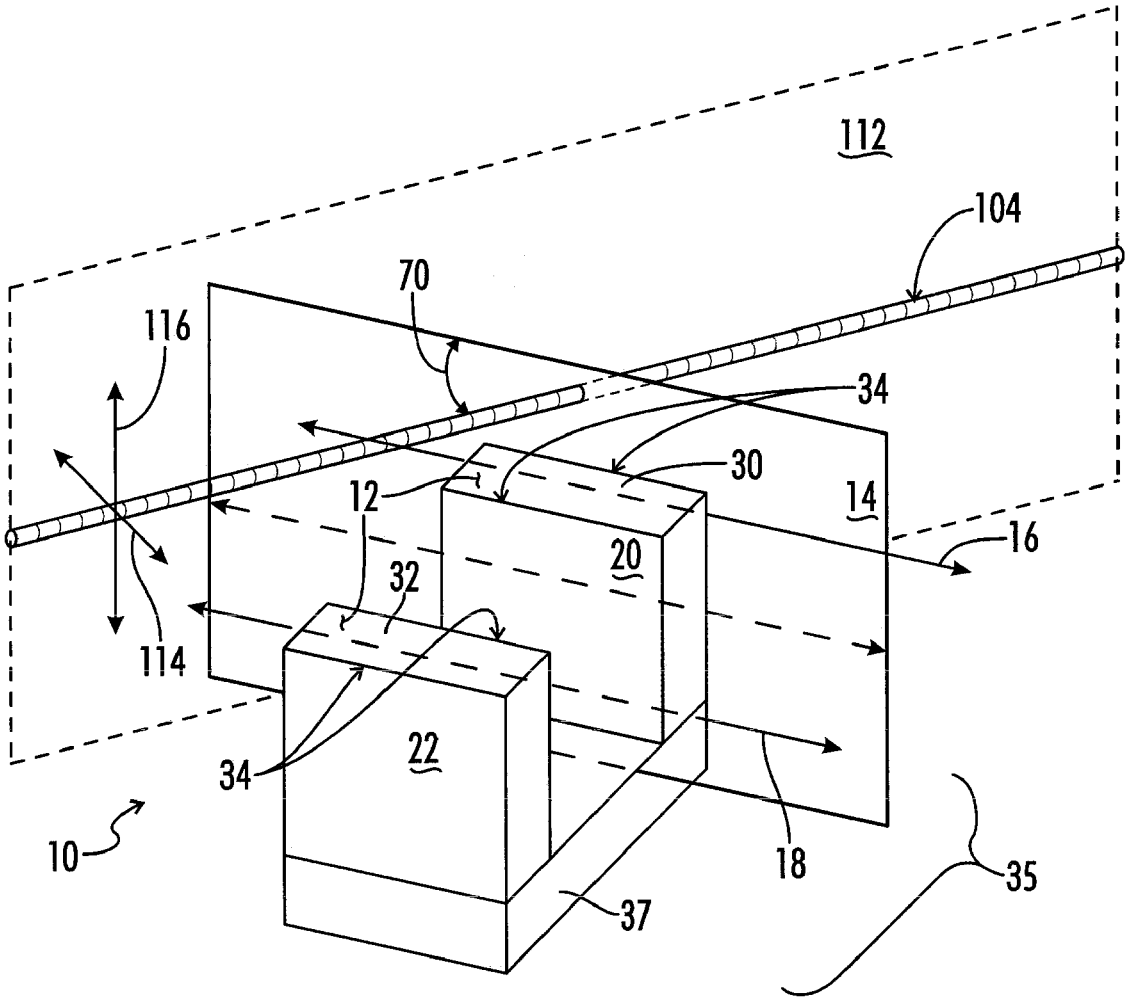
FIG. 5 is an oblique view of the transducer of FIG. 4 showing the permeable poles and permanent magnet of the transducer in operational spatial relation to the selected string.
Figure 6:
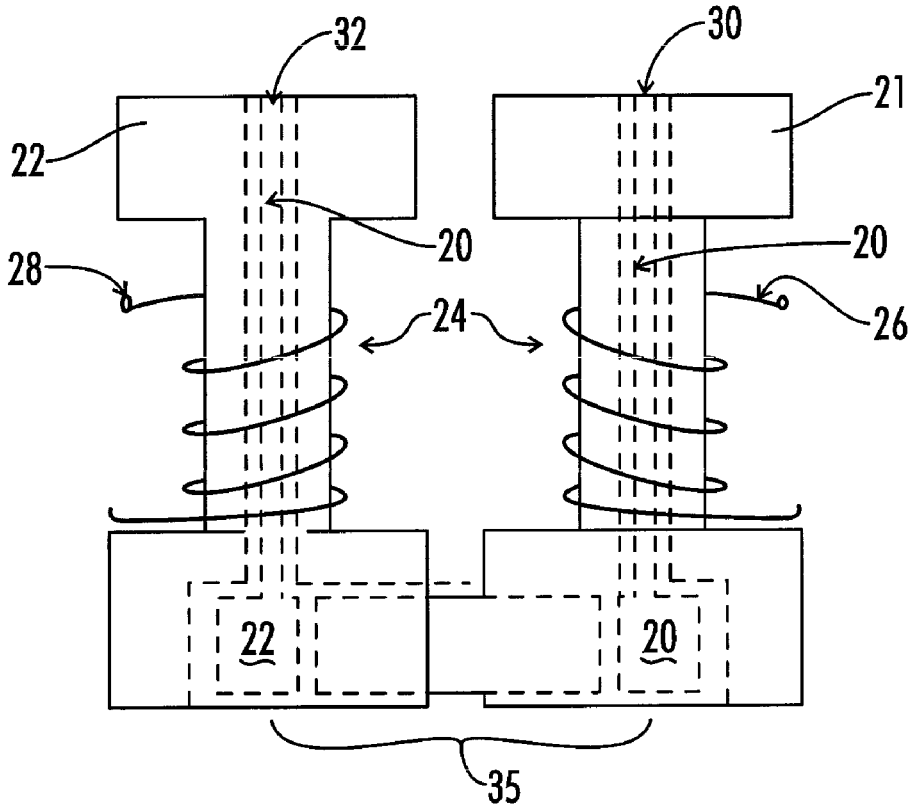
FIG. 6 is a cross-sectional view of the transducer of FIG. 4.

FIG. 3 shows one embodiment of the reluctance transducer 10 of the present invention mounted beneath a selected, corresponding string 104 and a neighboring second string 106 spaced adjacent to the first string 104. FIGS. 4 and 6 show detailed plan and cross-sectional views of the transducer 10 in FIG. 3. FIG. 5 shows an oblique view of the magnetic components of the transducer 10 in spatial relation to each other and its corresponding string 104.

A novel feature of the present invention is the orientation of the pair of parallel elongated pole pieces 20, 22 of the transducer 10 in relation to the vibrating guitar string 104, the motion of which the transducer 10 is designed to sense. The twin pole piece transducer 10 of the present invention, when mounted on the guitar, is centered beneath the string 104 and is rotated such that the parallel elongated pole pieces 20, 22 are offset from the axis of the resting string 104 by an "orientation angle" 70. The orientation angle 70 is selected so as to optimize at least one measurable performance parameter of the transducer assembly 10 during play of the selected guitar string 104 and adjacent strings 106. Such performance parameters include channel-to-channel separation, frequency response, and dynamic response.

One embodiment of the transducer 10 as shown in FIGS. 4, 5 and 6 includes a magnetic assembly 35 including first and second pole pieces 20, 22 with first and second pole ends 30 and 32, respectively. The first pole end 30 has a first magnetic polarity and the second pole end 32 has a second opposite polarity. The first pole end 30 is positioned near the second pole end 32 such that the first and second elongated pole end surfaces 36, 38, together with the space therebetween, form a transducer upper surface 12. In the embodiment shown in FIGS. 5 and 6, a permanent magnet 37 is shown adjacent the lower portions of the pole pieces 20, 22. In one optional embodiment, the pole pieces are each permanent magnets. This invention also contemplates an alternate embodiment in which the first pole end 30 and the second pole end 32 have the same magnetic polarity.

In one preferred embodiment, the first and second pole pieces 20, 22 are two magnetically permeable metallic bars substantially similar in their composition and dimensions. The metallic bars form blade-type pole pieces 20, 22 having rectangular pole end surfaces 36, 38. In this preferred embodiment, the first and second pole pieces 20, 22 are aligned such that the transducer upper surface 12 is generally rectangular. The transducer 10 of this preferred embodiment further includes two transducer bobbins 21 shown in FIG. 6. The bobbins provide cores to receive the pole pieces 20, 22 and a base cavity to receive the permanent magnet 37.

In FIG. 6, an electrical coil assembly 24 is shown disposed adjacent the magnet assembly 35 and positioned for sensing changes in the magnetic field 40 induced by movement of the selected string 104. In the embodiment shown, the coil assembly 24 includes a first coil 26 and a second coil 28 wound in opposite directions and connected in series. In a preferred embodiment, the first and second coils 26, 28 are each elongated so as to conform to the shape of the elongated cross-section of their respective pole piece. As shown in FIG. 6, the first pole piece 20 extends through the first coil 26 of the assembly 24 and the second pole piece 22 extends through the second coil 28. In this configuration, the first and second coils 26, 28 convert sensed changes in the magnetic field to corresponding first and second electrical signals. In a preferred embodiment, the first and second coils 26, 28 are connected in series so as to additively combine the first and second electrical signals.

Reference first and second pole end axes 16, 18 are shown in FIGS. 4 and 5 drawn along the elongated axes of the first and second end surfaces of the poles 36, 38, and are generally parallel. A transducer vertical plane 14 is shown defined between the first and second pole ends 30, 32. The transducer vertical plane 14 is shown generally normal to the transducer upper surface 12 and generally parallel to the first and second pole end axis 16, 18. When the transducer is mounted beneath the selected string 104, the reference vertical plane 112 is generally normal to and approximately bisects the transducer upper surface 12. FIG. 5 further shows the transducer vertical plane 14 intersecting the reference vertical plane 112 of the selected string 104 at a selected orientation angle 70.

Figure 9:
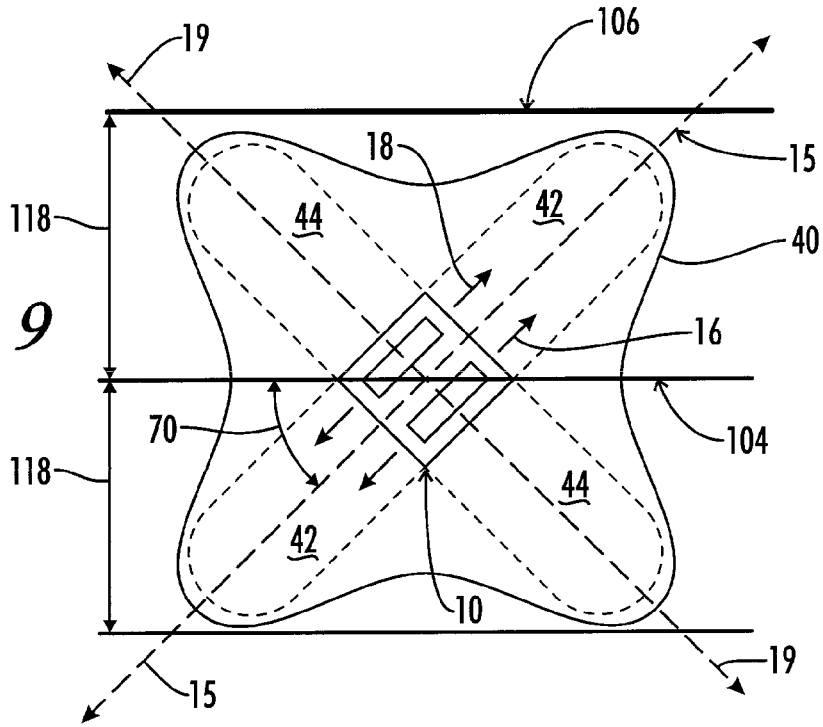
FIG. 9 is a plan view of a representative flux line of the magnetic field of the transducer of FIG. 4 disposed beneath the selected string at an optimal orientation angle.

As shown in FIG. 9, the first pole end 30 is magnetically operable with the second pole end 32 so as to define a primary portion 42 of the magnetic field 40. It is expected that the primary portion 42 of the magnetic field 40 is generally symmetric with respect to the transducer vertical plane 14 and is generally elongated along a primary field axis 15 that is generally parallel to the first and second pole end axes 16, 18. It is also expected that the magnetic field 40 further includes a secondary portion 44 extending along a secondary field axis 19 that is generally normal to the transducer vertical plane 14.

Without being bound by theory, the elongated pole pieces, unlike cylindrical pole pieces of the prior art, produce elongated primary and secondary lobes in the magnetic field that have unique properties in this application to pickup transducers. By changing the orientation of a transducer 10 beneath the selected magnetically permeable string 104, the angle at which a length of vibrating string 104 intersects the magnetic field lines is altered. Also altered is the number of field lines a given length of string 104 intersects during vibrations, and thus the induced electrical signals sensed by the coils 26, 28 are changed.

Referring to FIGS. 5 and 9, magnetic field lines would start at one pole end 30 and traverse arcs (not shown) to the second pole end 32. Such arcs would be similar to those of a horseshoe magnet and, thus, symmetric to the transducer vertical plane 14. As shown in FIG. 5, vibrational movement of the selected string 104 within the primary portion 42 of the magnetic field 40 is divisible into a y-motion vector having a direction 116 within the reference vertical plane 112 and an x-motion vector having a direction 114 normal to the reference vertical plane 112. The magnetic flux created by a vibration of a sensed length of the selected string 104 within the primary portion 42 of the magnetic field 40 is divisible into a y-flux vector having a direction 116 and an x-flux vector having a direction 114.

A novel aspect of the current invention is that the orientation angle can be selected so as to optimize the X-Y motion sensing for a given transducer 10. Without being bound by theory, it is expected that the orientation angle is so selected such that the ratio of the y-motion vector to the x-motion vector is approximately equal to a multiple of between 0.5 and 2.0 of the ratio of the y-flux vector to the x-flux vector. More preferably, the orientation angle is so selected such that the ratio of the y-motion vector to the x-motion vector is approximately equal to the ratio of the y-flux vector to the x-flux vector. It is expected that such a selected orientation captures the majority of X-Y motion of the string 104 completely through orientation of the elongated magnetic field produced between the pair of elongated pole pieces 20, 22. This novel feature has the advantage of capturing the X-Y motion without the need for the sophisticated circuit processing or pole piece/coil design of the prior art.

A second novel aspect of the current invention is that the orientation angle can be selected so as to optimize the dynamic response/signal-to-noise ratio achievable for a given transducer 10. Without being bound by theory, it is expected that the orientation angle is so selected such that the total magnetic flux created by a vibration of a sensed length of the selected string 104 within the primary portion 42 of the magnetic field 40 is maximized. This novel feature has the advantage of increasing the sensitivity to the sensed motion without increasing the sensitivity to non-directional ambient magnetic noise and, thus, increasing the dynamic response/signal-to-noise ratio achievable for a given transducer 10.

Figure 10:
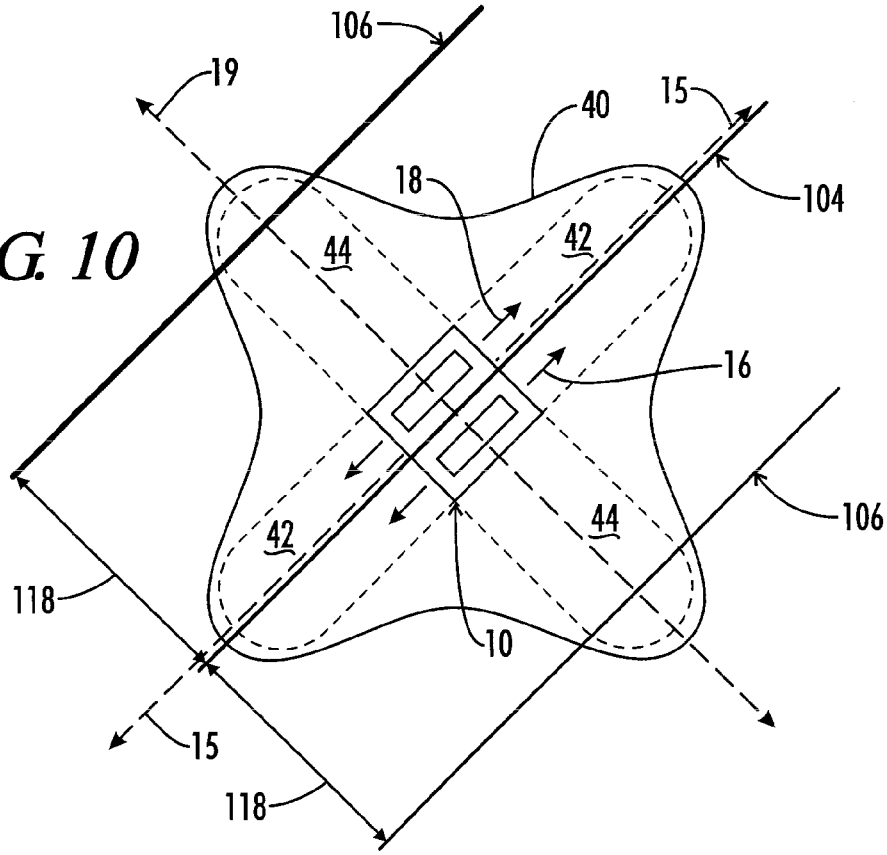
FIG. 10 is a plan view of a representative flux line of the magnetic field of the transducer of FIG. 4 disposed beneath and in alignment with the selected string.

Referring now to FIGS. 9 and 10, a third novel aspect of the invention is shown. Both FIGS. 9 and 10 show a selected string 104 with adjacent strings 106 separated from the selected string 104 by a standard string spacing 118. As shown in one embodiment of the invention in FIG. 9, the orientation angle is selected such that the portion of the magnetic field intersected by the adjacent strings 106 is minimized as compared to the "zero angle" orientation of the transducer shown in FIG. 10. In the embodiment of the invention shown in FIG. 9, the orientation angle can be selected such that the total magnetic flux created by a vibration of a sensed length of the adjacent string 106 within the magnetic field 40 is minimized for a given transducer 10. Thus, third novel aspect of the current invention is that the orientation angle can be selected so as to maximize the channel-to-channel separation (i.e. minimize the cross-talk or noise signals from adjacent strings 106) achievable for a given transducer 10.

Finally, an empirical fourth novel aspect of the present invention is that the orientation angle can be selected so as to produce a "flat" frequency response (i.e. no distortion of the frequency response curve) over the frequency range of the transducer.

An examination of FIG. 9 suggests that where the primary and secondary portions 42, 44 of the magnetic field are equal in size, the optimal orientation angle would theoretically be 45 degrees. One embodiment of the transducer 10 shown in FIGS. 4, 5 and 6 was constructed for experimentation. Initial experimentation has shown that selection of an orientation angle 70 of between approximately 28 degrees and approximately 58 degrees, and more preferably between approximately 38 degrees and approximately 48 degrees, and most preferably at approximately 43 degrees, optimizes at least one measurable performance parameter of the transducer assembly 10 during play of the guitar. The experimentally measured parameters included channel-to-channel separation, frequency response and dynamic response/signal-to-noise ratio.

In an experimental embodiment of the present invention, an orientation angle 70 of approximately 43 degrees was determined to produce a measured flat frequency response over a frequency range from approximately 20 Hz. to approximately 20,000 Hz. ±5 dB. This measurement was accomplished by an FFT analysis comparing the sensed string signal with the string signal measured by a known flat frequency device, in this example an Earthworks 550M test microphone having a flat frequency response over a frequency range from approximately 5 Hz. to approximately 50,000 Hz. ±0.333 dB. This result is also an experimental indicator of approximately equal sensitivity to X direction and Y direction movement of the string.

In the experimental embodiment of the present invention, an orientation angle 70 of approximately 43 degrees was also experimentally determined to produce the greatest channel-to-channel separation (i.e. least cross-talk noise from adjacent strings) and the greatest dynamic response/signal-to-noise ratio. In this experiment the string separation distance 118 was 0.405 inches.

Figure 7:
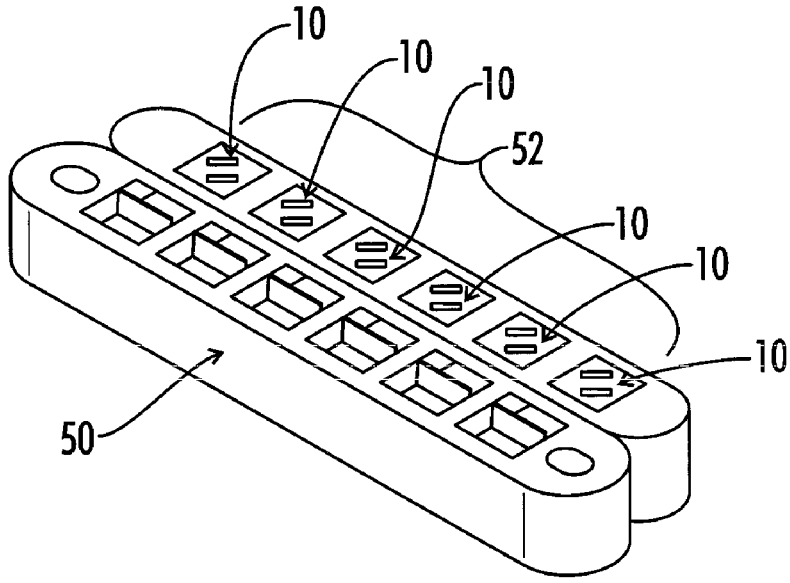
FIG. 7 is an oblique view of a polyphonic pickup assembly having a plurality of the transducers of FIG. 4.
Figure 8:
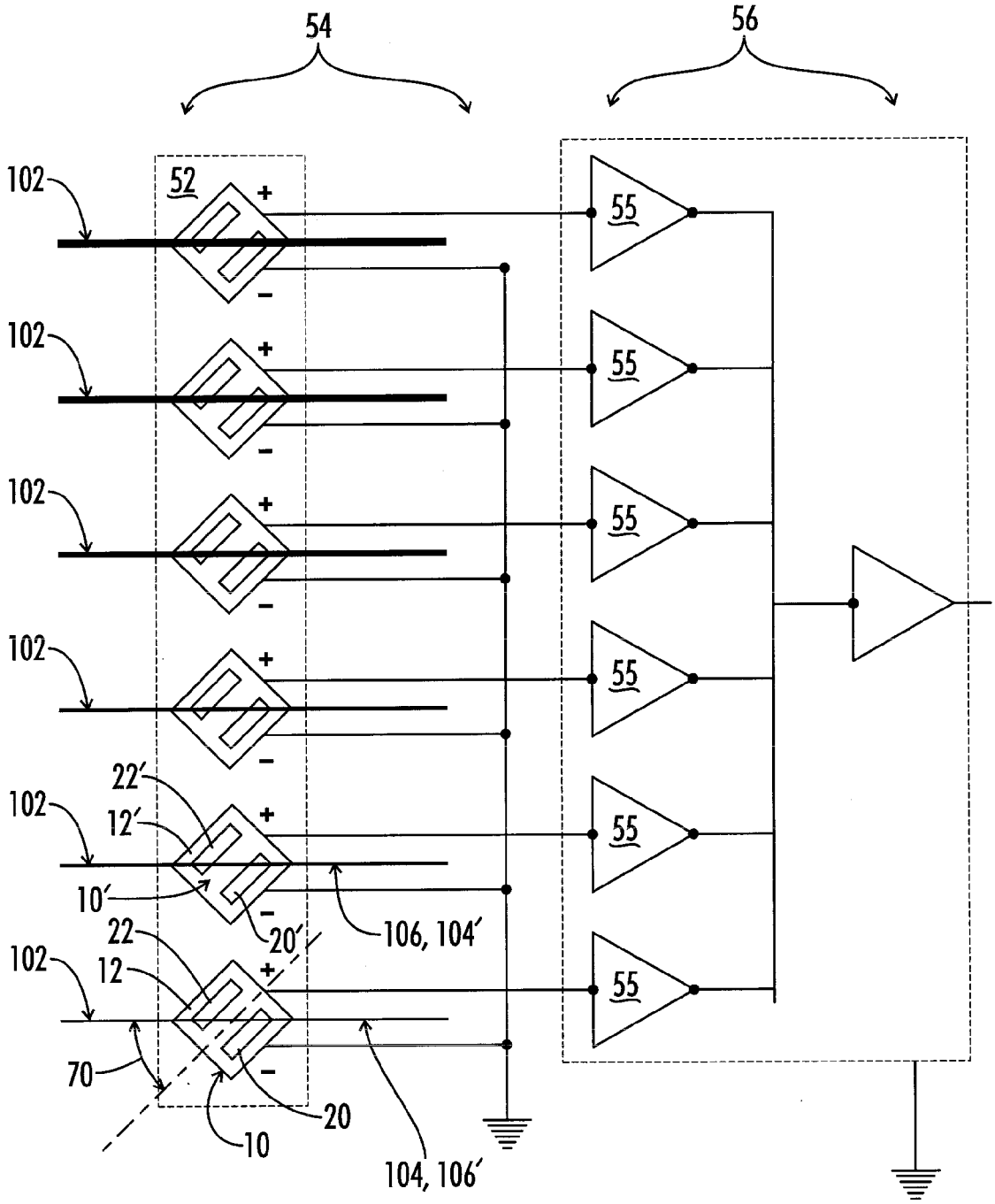
FIG. 8 is a block diagram of the circuit assembly of the pickup assembly of FIG. 7 connected to a digital processing circuit.

Referring now to FIG. 7, a polyphonic pickup assembly 50 for an electric guitar is shown having six transducer assemblies 10 of the present invention. The polyphonic pickup assembly 50 is shown in FIG. 1 mounted on a guitar with each guitar string 102 having a separate transducer 10 mounted beneath it and rotated to an orientation angle 70 relative to the corresponding reference vertical plane 112. FIG. 8 shows the pickup circuit 54 of one embodiment of the polyphonic pickup assembly 50. In this embodiment, the pickup circuit connects in parallel each pair of series connected first and second coils 26, 28 of each transducer assembly. The combined first and second electrical signals of each transducer 10 is then output to a separate amplifier 55 in the digital processing circuit 56 of, for example, a digital guitar.

The polyphonic pickup 50 of the invention incorporates multiple transducers 10, each rotated to a selected orientation angle 70. These orientation angles can be selected to optimize measured performance parameters in various combinations. For example, in accordance with one embodiment, the polyphonic pickup 50 is adapted such that the orientation angle of each transducer 10 is selected so as to optimize at least one measurable performance parameter of the corresponding transducer 10 during play of the guitar. In accordance with another embodiment, the polyphonic pickup 50 is adapted such that the orientation angle of each transducer 10 is selected so as to optimize at least one measurable aggregate performance parameter of the combined transducers 10 during play. Finally, in accordance with yet another embodiment, the polyphonic pickup 50 is adapted such that the orientation angle of each transducer 10 is selected so as to optimize at least one measurable performance parameter of the one selected transducer 10 during play.

The present invention contemplates alternate embodiments having a single elongated pole piece, such as a blade-type pole piece as described above, producing elongated lobes in the magnetic field of the transducer. In one alternate embodiment, the single elongated pole piece extends through two stacked, oppositely wound wire coils that are wired in series. With this single blade pickup mounted between a selected magnetically permeable string of a stringed instrument and a surface of the instrument over which the selected string spans, the pickup is disposed such that a projection of the string generally normal to the surface of the instrument intersects at least one of the elongated sides of the first or second pole ends at an orientation angle selected so as to optimize at least one measurable performance parameter of the transducer assembly during play of the stringed instrument.

Thus, although there have been described particular embodiments of the present invention of a new and useful Angled Pickup For Digital Guitar, it is not intended that such references be construed as limitations upon the scope of this invention except as set forth in the following claims.

What is claimed is:

1. A reluctance pickup for a stringed musical instrument comprising:

a first blade-shaped pole piece disposed within a first wire coil and including a first elongated pole end extending from said first coil, the first pole piece having a first magnetic polarity, the first elongated pole end having two opposing elongated sides; and a second blade-shaped pole piece disposed in a spaced relation with the first pole piece, the second pole piece further disposed within a second wire coil and including a second elongated pole end extending from said second coil, the second pole piece having a second polarity, the second elongated pole end having two opposing elongated sides, the opposing elongated sides of the first and second pole ends being approximately co-planar and parallel, wherein, with the pickup mounted between a selected magnetically permeable string of a stringed instrument and a surface of the instrument over which the selected string spans, the pickup is disposed such that a projection of the string generally normal to the surface of the instrument intersects at least one of the elongated sides of the first or second pole ends at a selected orientation angle between approximately 28 degrees and approximately 58 degrees.

2. The reluctance pickup of claim 1, wherein the second polarity is opposite the first polarity, and wherein the selected orientation angle is between approximately 38 degrees and approximately 48 degrees.

3. The reluctance pickup of claim 2, wherein the selected orientation angle is approximately 43 degrees.

4. An electromagnetic transducer assembly for a stringed musical instrument having a plurality of magnetically permeable strings extending in a generally parallel spaced relation to each other across a span above a surface of the instrument so as to generally define a string plane, the transducer assembly being mounted adjacent a selected string in spaced relation thereto, the selected string defining a reference vertical plane generally normal to the string plane, the transducer assembly comprising:

a magnet assembly defining a magnetic field and including a first pole end with a first magnetic polarity and a second pole end with a second opposite polarity, the first and second pole ends having, respectively, a first and a second elongated pole end surface, the elongated portions thereof generally defining a first and second pole end axis, respectively, wherein, the first pole end is disposed in spaced relation to the second pole end such that:

(a) the first and second elongated pole end surfaces, together with the space therebetween, comprise a transducer upper surface;

(b) the first pole end axis is generally parallel to the second pole end axis; and (c) a transducer vertical plane is defined between the first and second pole ends, the transducer vertical plane being generally normal to the transducer upper surface and generally parallel to the first and second pole end axes; and an electrical coil assembly disposed adjacent the magnet assembly and positioned for sensing changes in the magnetic field induced by movement of the selected string, wherein, with the transducer assembly mounted beneath the selected string, the transducer vertical plane intersects the reference vertical plane at a selected orientation angle.

5. The assembly of claim 4, wherein the orientation angle is selected so as to optimize at least one measurable performance parameter of the transducer assembly during play of the stringed instrument.

6. The assembly of claim 5, wherein the optimized measurable performance parameter is selected from the group of measurable performance parameters including: channel-to-channel separation, frequency response, dynamic response, and any combinations thereof.

7. The transducer assembly of claim 4, wherein the coil assembly comprises a first and a second electrical coil, the first and second coils being oppositely wound and each positioned for sensing changes in the magnetic field induced by movement of the magnetically permeable string, wherein each first and second coil converts sensed changes in the magnetic field to corresponding first and second electrical signals, wherein, the magnet assembly comprises a first and a second pole piece, the first pole piece comprising the first pole end and extending through the first coil, the second pole piece comprising the second pole end and extending through the second coil.

8. The transducer assembly of claim 7, wherein the first and second pole pieces comprise two magnetically permeable metallic bars substantially similar in their composition and dimensions, each pole piece having a rectangular pole end surface, the first and second pole pieces aligned such that the transducer upper surface is generally rectangular, wherein, the first and second coils are each elongated so as to conform to the shape of the elongated cross-section of their respective pole piece, wherein, the reference vertical plane is generally normal to and approximately bisects the transducer upper surface, and wherein, the selected orientation angle is between approximately 28 degrees and approximately 58 degrees.

9. The transducer assembly of claim 8, wherein the selected orientation angle is between approximately 38 degrees and approximately 48 degrees.

10. The transducer assembly of claim 9, wherein the selected orientation angle is approximately 43 degrees.

11. The transducer assembly of claim 8, wherein the orientation angle is selected so as to optimize at least one measurable performance parameter of the transducer assembly during play of the stringed instrument.

12. The transducer assembly of claim 11, wherein the optimized measurable performance parameter is selected from the group of measurable performance parameters including: channel-to-channel separation, frequency response, dynamic response, and combinations thereof.

13. The transducer assembly of claim 8, wherein the first and second coils are connected in series so as to additively combine the first and second electrical signals.

14. The transducer assembly of claim 4, wherein the first pole end is magnetically operable with the second pole end so as to define a primary portion of the magnetic field, the primary portion of the magnetic field being generally symmetric with respect to the transducer vertical plane, the primary portion of the magnetic field further being generally elongated along a primary field axis that is generally parallel to the first and second pole end axes.

15. The transducer assembly of claim 14, wherein the orientation angle is selected such that the total magnetic flux created by a vibration of a sensed length of the selected string within the primary portion of the magnetic field is maximized.

16. The transducer assembly of claim 14, wherein the magnetic field further comprises a secondary portion of the magnetic field, the secondary portion of the magnetic field extending along a secondary field axis that is generally normal to the transducer vertical plane, wherein, the plurality of magnetically permeable strings includes a second string disposed adjacent the selected string with a spacing there between, wherein the orientation angle is selected such that the total magnetic flux created by a vibration of a sensed length of the adjacent string within the magnetic field is minimized.

17. The transducer assembly of claim 14, wherein, vibrational movement of the selected string within the primary portion of the magnetic field is divisible into an y-motion vector having a direction defined by the reference vertical plane and an x-motion vector having a direction defined by a plane normal to the reference vertical plane, wherein, the magnetic flux created by a vibration of a sensed length of the selected string within the primary portion of the magnetic field is divisible into an y-flux vector having a direction defined by the reference vertical plane and an x-flux vector having a direction defined by a plane normal to the reference vertical plane, and wherein, the orientation angle is selected such that the ratio of the y-motion vector to the x-motion vector is approximately equal to a multiple of between 0.5 and 2.0 of the ratio of the y-flux vector to the x-flux vector.

18. The transducer assembly of claim 17, wherein, the orientation angle is selected such that the ratio of the y-motion vector to the x-motion vector is approximately equal to the ratio of the y-flux vector to the x-flux vector.

19. A polyphonic pickup assembly for a stringed musical instrument having a plurality of magnetically permeable strings extending in a generally parallel and evenly spaced relation to each other across a span above a surface of the instrument so as to generally define a horizontal string plane, the plurality of strings each defining a separate vertical string plane, each vertical string plane being generally normal to the horizontal string plane, the polyphonic pickup assembly comprising:

a plurality of the transducer assemblies, each transducer assembly being adapted to be mounted adjacent a selected string in spaced relation thereto, each transducer assembly comprising:

a first and a second pole piece defining a magnetic field, the first pole piece comprising a first pole end with a first magnetic polarity, the first pole end extending through a first coil, the second pole piece comprising a second pole end with a second opposite polarity, the second pole end extending through a second coil, the first and second coils being oppositely wound and each positioned for sensing changes in the magnetic field induced by movement of a magnetically permeable string, wherein each first and second coil converts sensed changes in the magnetic field to corresponding first and second electrical signals, the first and second pole ends having, respectively, a first and a second elongated pole end surface, the elongated portions thereof generally defining first and second pole end axes, respectively, wherein, the first pole end is disposed in spaced relation to the second pole end such that:

(a) the first and second elongated pole end surfaces, together with the space therebetween, comprise a transducer upper surface;

(b) the first pole end axis is generally parallel to the second pole end axis; and (c) a transducer vertical plane is defined between the first and second pole ends, the transducer vertical plane being generally normal to the transducer upper surface and generally parallel to the first and second pole end axes; and a circuit connecting each of the plurality of transducer assemblies, wherein, with each transducer assembly mounted beneath one selected string, the vertical string plane corresponding to such selected string is generally normal to and approximately bisects such transducer upper surface, and such transducer vertical plane intersects such vertical string plane at a selected orientation angle between approximately 28 degrees and approximately 58 degrees.

20. The polyphonic pickup assembly of claim 19, wherein, for each transducer assembly, the orientation angle is selected so as to optimize at least one measurable performance parameter of said transducer assembly during play of the stringed instrument.

21. The polyphonic pickup assembly of claim 19, wherein, for the plurality of transducer assemblies, the orientation angle is selected so as to optimize at least one measurable performance parameter of the plurality of transducer assemblies during play of the stringed instrument.

22. The polyphonic pickup assembly of claim 19, wherein, for the plurality of transducer assemblies, the orientation angle is selected so as to optimize at least one measurable performance parameter of a selected transducer assembly during play of the stringed instrument.

* * * * *